US005526857A

United States Patent [19]

Forman

[11] Patent Number: 5,526,857

[45] Date of Patent: Jun. 18, 1996

[54] METHOD OF MANUFACTURE OF VENEERED DOOR WITH RAISED PANEL

[76] Inventor: Alan S. Forman, 5091 Lake Fjord Pass, Atlanta, Ga. 30068

[21] Appl. No.: 473,569

[22] Filed: Jun. 6, 1995

[51] Int. Cl.[6] ..... B27D 1/00; B27M 1/08

[52] U.S. Cl. ..... 144/346; 52/311.2; 52/784.1; 144/347; 144/354; 144/367; 144/371; 156/256; 156/258; 156/304.1; 428/58; 428/106

[58] Field of Search ..... 156/219, 71, 256, 156/258, 266, 510, 517, 304.1, 304.5; 428/50, 58, 106, 192; 52/311.2, 312, 299, 784.1, 789.1; 144/329, 346, 350, 351, 347, 352, 355, 367, 371, 354

[56] References Cited

U.S. PATENT DOCUMENTS

| | | | |
|---|---|---|---|
| 4,060,437 | 11/1977 | Strout | 144/346 |
| 4,327,788 | 5/1982 | Turner | 144/351 |
| 4,471,012 | 9/1984 | Maxwell | 156/258 |
| 4,702,054 | 10/1987 | Turner | 52/311.2 X |
| 4,704,834 | 11/1987 | Turner | 52/311.2 |
| 4,756,350 | 7/1988 | Turner | 144/346 |
| 4,853,062 | 8/1989 | Gartland | 144/351 X |
| 5,433,806 | 7/1995 | Pasquali | 144/346 X |

*Primary Examiner*—W. Donald Bray
*Attorney, Agent, or Firm*—Harry I. Leon

[57] ABSTRACT

A method of making a veneered door with a raised central panel that is elongated and vertically oriented in which only three pieces need to be assembled. A suitable wood or wood-like stock is machined to form first and second elongated, generally rectangular substrates and then a flexible veneer with a simulated or real wood grain is affixed to each of these substrates. In the finished door, the grain of the veneer applied to the first substrate and to the second substrate runs, respectively, generally parallel to and generally perpendicularly to the longitudinal axis of the central panel. At least one single, unitary piece defining the central panel and two vertically-oriented framing members is fabricated from the veneered first substrate. First and second horizontally-disposed framing members are fabricated from the veneered second substrate by cutting it into at least two segments, each having an overall length which is approximately equal to the transverse width of the first substrate and each having distal ends which slope towards each other at a 45 degree angle to the longitudinally-extending edges of the second substrate. The first substrate is also cut transversely, thereby establishing the overall length of the first piece; cutouts are then formed in the top and bottom ends thereof for receiving the first and second horizontally-disposed framing members, respectively; and each of these framing members is glued along its distal ends and one of its longitudinally-extending edges to the unitary piece defining the central panel and the two vertically-oriented framing members.

2 Claims, 2 Drawing Sheets

METHOD OF MANUFACTURE OF VENEERED DOOR WITH RAISED PANEL

BACKGROUND OF THE INVENTION

Raised panel doors with natural wood finishes are popular for kitchen and bathroom cabinets as well as for full-size doors. Traditionally, such doors are fabricated by banding a solid central panel between four sections of solid lumber or framing elements, each framing element having a greater thickness in cross-section than the central panel. In all, five pieces are required to complete the door so fabricated.

Due to escalating lumber prices, the manufacture of these traditional doors has become expensive. In order to reduce costs, some have resorted to milling the central panel and each of the framing elements from man-made materials. As is well known, certain wood-like, man-made materials can be fabricated in complex shapes and then made to resemble solid wood by stretching a suitably patterned, thin, flexible veneer over their surfaces and adhering it thereto. To simulate natural wood grain, the veneer must be oriented similarly to that which the framing elements would have if they were made of solid hard wood or the like. That is, the veneer must be affixed with the grain oriented substantially parallel to the longitudinally-extending edges of each framing element. Unfortunately, when raised panel doors are manufactured using four framing members and a central panel of veneered, man-made materials instead of solid wood, little, if any, cost savings are realized over making the traditional doors which they resemble.

SUMMARY OF THE INVENTION

The object of this invention is to provide a method of making a raised panel door using man-made materials which is similar in appearance to a solid wood door but which is less expensive to construct.

In accordance with the present invention, there is provided a method of making a veneered door with a raised central panel that is elongated and vertically oriented. The method requires the assembly of only three pieces to complete the door. A suitable wood or wood-like stock is machined to form a first substrate from which at least one single, unitary piece defining the central panel and two vertically-oriented framing members is subsequently fabricated. Prior to fabricating the unitary piece, a flexible layer of veneer with a simulated or, alternately, a real wood grain is affixed to the first substrate. In the finished door, the grain of this veneer layer runs parallel to the longitudinal axis of the central panel. Similarly, suitable wood or wood-like stock is machined to form a second substrate from which, once a flexible veneer with a simulated or, alternately, a real wood grain has been affixed to the second substrate, first and second horizontally-oriented framing members are fabricated. The veneer layer so affixed displays a wood grain that runs generally parallel to the longitudinally-extending edges of the finished first and second horizontally-disposed framing members. As the final step in fabricating the first and second horizontally-disposed framing members, the second substrate is cut into at least two segments each having an overall length which is approximately equal to the overall traverse width of the first substrate. Further, the distal ends of each segment are beveled, sloping towards each other at a 45 degree angle to the longitudinally-extending edges of the second substrate. Finally, the first substrate is cut traversely to establish the overall length of the first piece; cutouts are formed in the top and bottom ends thereof for receiving the first and second horizontally-disposed framing members, respectively; and each of these framing members is bonded along its distal ends and the shorter of its two longitudinally-extending edges to the unitary piece defining the central panel and the two vertically-oriented framing members.

DETAILED DESCRIPTION OF THE PREFERRED EMBODIMENT

Figure 1:
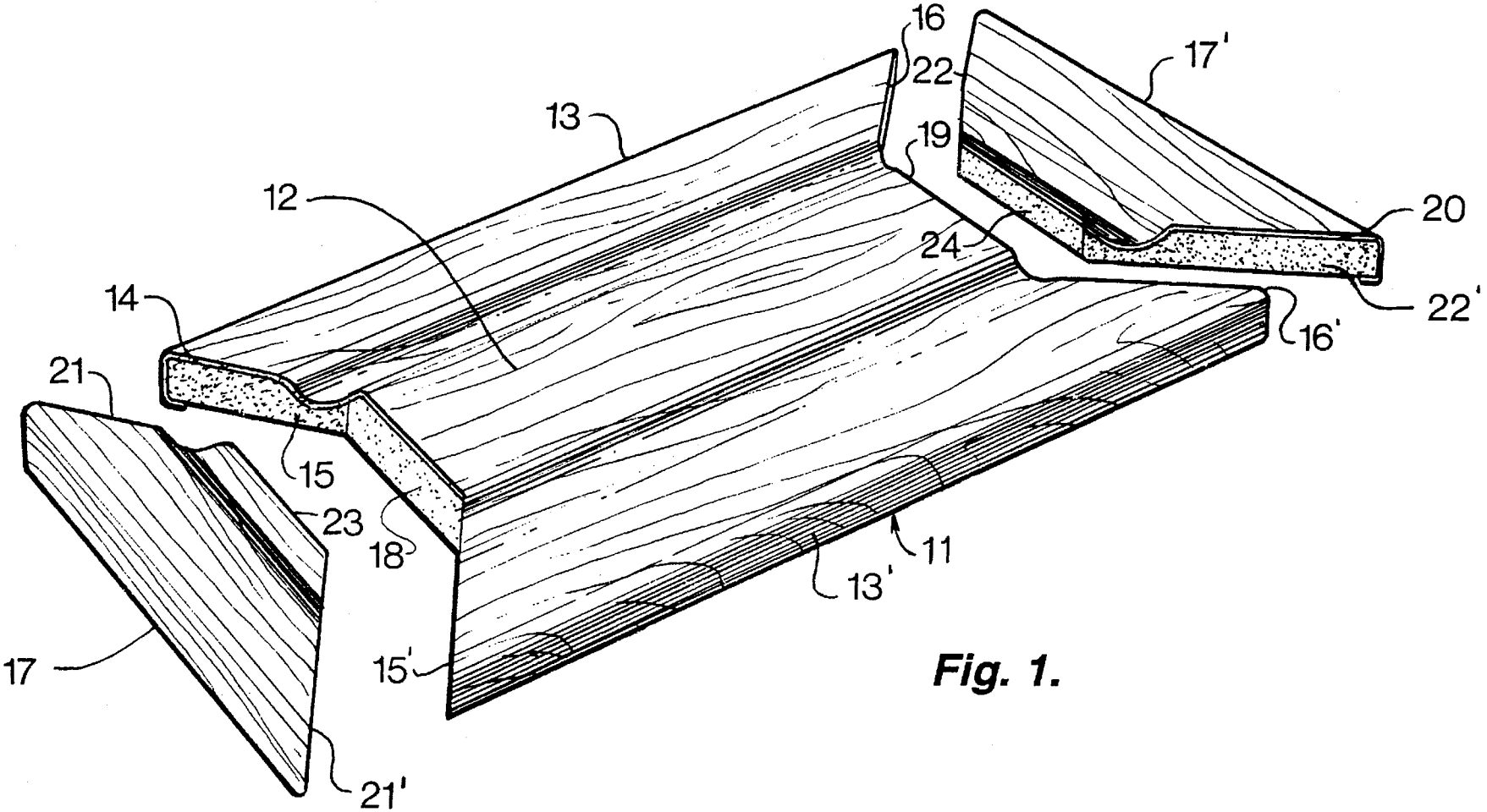
FIG. 1 is an exploded perspective view of the door with raised panel according to the present invention.

In the drawings, there is shown a veneered door 10 with a raised panel 12 made in accordance with a preferred embodiment of this invention. Fabricated basically from three veneered pieces, the door 10 includes two horizontally-oriented framing members 17, 17' and a single, unitary piece 11 which defines the raised panel 12 and two vertically-oriented framing members 13, 13'.

Prior to veneer 14 being attached thereto, the piece 11 is machined from a first substrate of an inferior wood, pressed wood, or a wood substitute, such as a medium density fiberboard ("MDF"), particle board, chip board or rigid plastic foam. The first substrate is molded or machined to a point that it has approximately the same transverse width and cross-section throughout its length, exclusive of veneer and fittings, as does the finished door 10 in the portion thereof which includes the raised panel 12 and the two vertically-oriented framing members 13, 13'. The first substrate may be any length up to about 16 feet, with an optimum length being about 10 feet.

Then a thin, flexible veneer 14 having a suitable wood grain pattern, such as one of the veneers commercially available from Constantine's Headquarters, 20 Eastchester Road, Bronx, N.Y., is affixed to the outer surface of the first substrate as well as to its side edges and to a portion of its inner surface proximate with the side edges. Among the well-known techniques used to so affix the veneer 14 are gluing it to the substrate with the use of contact cement, a hot melt glue or the like and then pressing the veneer onto the contiguous surface of the first substrate with soft rubber or silicon roller(s). In the case of complex edges, veneer 14 can be applied thereto using Jorde's techniques taught in U.S. Pat. No. 5,312,504. The veneer 14 is attached to the first substrate in such a way that wood grain runs generally parallel to the longitudinal centerline thereof.

Figure 2:
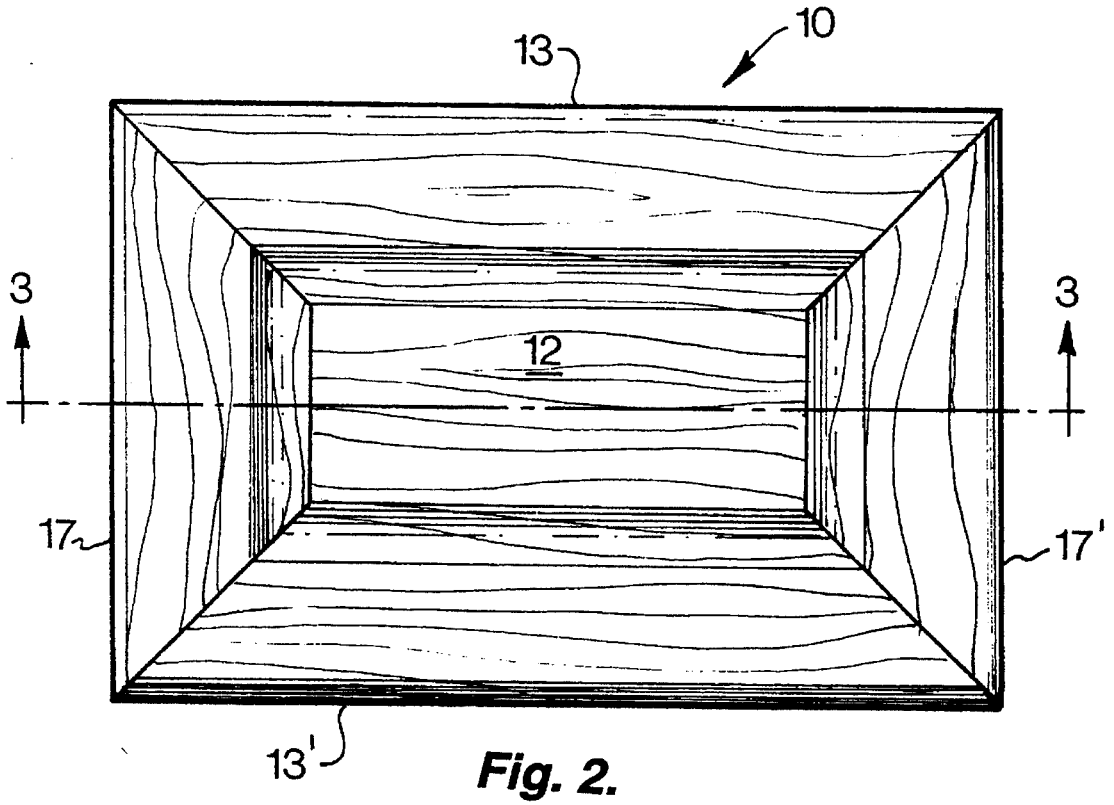
FIG. 2 is a plan view, on a reduced scale, of the door according to FIG. 1 when fully assembled.
Figure 3:
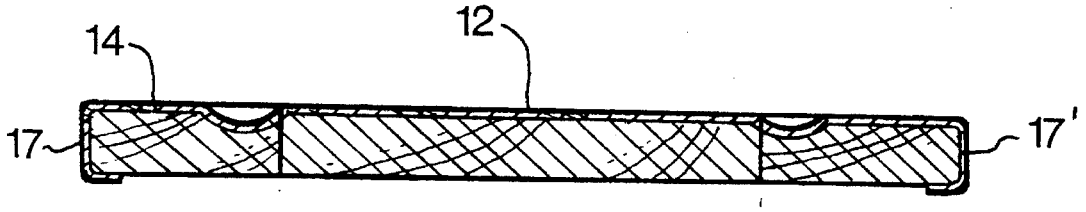
FIG. 3 is a cross-sectional view taken along line 3—3 of FIG. 2 showing a butt joint between contiguous pieces of the door according to FIG. 1.

With the veneer 14 in place, the first substrate is cut transversely to form at least one elongated section having an overall length equal to that of the finished door 10. Next each of the distal ends of this section is machined to form a three-sided cutout, thereby completing the piece 11. Each of these cutouts has a pair of beveled edges 15, 15'; 16, 16' and a middle edge 18, 19. Preferably, the beveled edges 15, 15';

16, 16' are disposed at a 45 degree angle to the longitudinal centerline of the piece 11 (FIGS. 1 and 2). Disposed perpendicularly to the longitudinal centerline of the piece 11, the middle edge 18, 19 is juxtaposed between the beveled edges 15 and 15'; 16 and 16', respectively.

In the preferred embodiment, preparation of the piece 11 is accompanied by a simultaneous preparation of the horizontally-oriented framing members 17, 17'. The members 17, 17' are machined from a second substrate of an inferior wood or a wood substitute, which has at least as great a transverse width as does the framing member 17, 17' in the finished door 10. Molded or machined to a point that it has approximately the same transverse cross-section throughout its length, the second substrate may be any length up to about 16 feet. A portion of the transverse cross-section of the second substrate bounded by at least one of its edges is approximately a duplicate, exclusive of veneer and fittings, of the transverse cross-section of the framing member 17, 17' along its midsection within the assembled door 10.

In a manner similar to that employed to affix the veneer 14 to the first substrate, a thin flexible veneer 20 having a suitable wood grain is attached to the second substrate. The veneer 20 is mounted thereon with the grain running generally parallel to the longitudinally-extending side edges of the second substrate. Affixed to the outer surface of the second substrate, the veneer 20 stretches around at least one of its side edges and is attached not only to it but also to a contiguous portion of the inner surface of the second substrate.

Each horizontally-oriented framing member 17, 17' is then cut along three of its sides to define a pair of beveled ends 21, 21'; 22, 22' respectively, disposed between two longitudinally-extending side edges of uneven length. After this cut, the longer of these side edges, which remains covered with veneer, is approximately equal in length to the transverse width of the finished door 10. The shorter side edge 23, 24, on the other hand, is approximately as long as the middle edge 18, 19, respectively, of each of the 3-sided cutouts defined by the piece 11.

The door 10 is completed by forming a miter joint between the beveled edges 15, 15'; 16, 16' of the three-sided cutouts in the piece 11 and the beveled edges 21, 21'; 22, 22' respectively, of the horizontally-oriented framing members 17, 17'. Simultaneously, the transverse edges 18, 19 of the piece 11 are butt-jointed against the side edges 23, 24, respectively, of the framing members 17, 17' and secured thereto. In general, the joints between the piece 11 and the framing members 17, 17' are held together with either glue, fasteners or both; and only fine cracks are present along the miter and butt joints between the piece 11 and the framing members 17, 17', much as occur in a traditional door made of natural wood.

Figure 4:
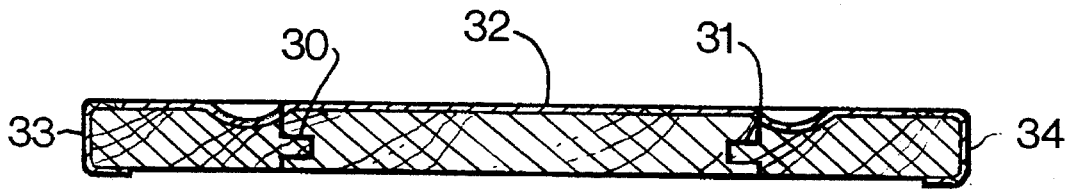
FIG. 4 is a cross-sectional view taken along line 3—3 of FIG. 2 of an alternate embodiment of the door with raised panel according to the present invention, the alternate embodiment having a butt joint between contiguous pieces of the door.

According to an alternate embodiment of the invention, horizontally-oriented framing members 33, 34 resemble the framing members 17, 17' except that the former also define a tongue 30 (FIG. 4). In addition, the single, unitary piece to which the framing members 33, 34 are joined is similar to the piece 11 except that the raised panel 12 therein is replaced by a raised panel 32 (FIG. 4). In the panel 32, each transverse edge thereof defines a groove 31 for receiving the tongue 30 protruding from one of the framing members 33, 34, so that a tongue-and-groove joint can be formed between it and the single, unitary piece when the door is assembled.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A method of making a veneered door with an elongated, vertically-oriented raised panel which appears to have both horizontally- and vertically-oriented framing members, which comprises:

(a) machining an elongated first substrate that in transverse cross-section is approximately equivalent to a portion of the door in tranverse cross-section, said portion including the raised panel and the two vertically-oriented framing members;

(b) affixing a thin flexible veneer to outer surface and longitudinally-extending edges of the first substrate;

(c) cutting the first substrate, once the veneer has been affixed thereto, to length;

(d) machining a three-sided cutout in each of the opposing distal ends of the veneered first substrate, each three-sided cutout being defined by a transversely-extending edge which is approximately as long as the raised panel is wide and by a first pair of beveled edges which slope inwardly at an angle of 45 degrees to the transversely-extending edge;

(e) machining an elongated second substrate that in transverse cross-section is at least as wide as each of the horizontally-oriented framing members, a portion of the transverse cross-section of the second substrate contiguous with one of its longitudinally-extending edges being approximately equivalent to each of the horizontally-oriented framing members in transverse cross-section;

(f) affixing a thin flexible veneer to outer surface and at least one longitudinally-extending edge of the second substrate; and (g) machining the veneered second substrate to form the horizontally-oriented framing members, the second substrate being machined, for each horizontally-oriented framing member, along three edges, including forming a second pair of beveled edges which slope inwardly at an angle of 45 degrees to the third edge which is juxtaposed between the second pair of beveled edges the third edge being approximately as long as the raised panel is wide.

2. A method of making a veneered door with an elongated, vertically-oriented central panel from only three basic parts, comprising:

(a) machining a three-sided cutout in each of two opposing ends of an elongated, veneered first substrate, each three-sided cutout being defined by a transversely-extending edge which is approximately as long as the central panel is wide and by a first pair of beveled edges which slope inwardly at an acute angle to the transversely-extending edge; and (b) machining a veneered second substrate to form two parts, the second substrate being machined, for each of these two parts, along each of three edges, including forming a second pair of beveled edges which slope inwardly at said acute angle to the third edge which is juxtaposed between the second pair of beveled edges, the third edge being approximately as long as the central panel is wide.

* * * * *